US008593369B2

(12) United States Patent
Storz

(10) Patent No.: US 8,593,369 B2
(45) Date of Patent: Nov. 26, 2013

(54) ANTENNA ASSEMBLY

(75) Inventor: Gregor Storz, Auckland (NZ)

(73) Assignee: Navico Holding AS, Egersund (NO)

( * ) Notice: Subject to any disclaimer, the term of this patent is extended or adjusted under 35 U.S.C. 154(b) by 1046 days.

(21) Appl. No.: 12/269,245

(22) Filed: Nov. 12, 2008

(65) Prior Publication Data

US 2010/0117923 A1 May 13, 2010

(51) Int. Cl.
*H01Q 1/12* (2006.01)

(52) U.S. Cl.
USPC ..... 343/878; 343/700 MS

(58) Field of Classification Search
USPC ..... 343/844, 837, 878, 700 MS
See application file for complete search history.

(56) References Cited

U.S. PATENT DOCUMENTS

| | | | | |
|---|---|---|---|---|
| 2,573,914 | A | 11/1951 | Landon | |
| 5,541,612 | A * | 7/1996 | Josefsson | 343/771 |
| 5,757,246 | A * | 5/1998 | Johnson | 333/12 |
| 5,896,104 | A | 4/1999 | Komatsu et al. | |
| 6,025,798 | A | 2/2000 | Colombel et al. | |
| 6,181,290 | B1 * | 1/2001 | Zaitsev et al. | 343/786 |
| 6,972,729 | B2 * | 12/2005 | Wang | 343/833 |
| 7,538,728 | B1 * | 5/2009 | Chang et al. | 343/700 MS |
| 2007/0146225 | A1 * | 6/2007 | Boss et al. | 343/797 |
| 2008/0258978 | A1 * | 10/2008 | Stuart | 343/700 MS |

FOREIGN PATENT DOCUMENTS

| | | | |
|---|---|---|---|
| DE | 10 2005 061 636 | A1 | 6/2007 |
| EP | 0 669 673 | A1 | 8/1995 |
| JP | 62-204605 | A | 9/1987 |
| JP | 2003-152433 | A | 5/2003 |

OTHER PUBLICATIONS

Randome Scanners Users Guide, Mar. 2006.
International Search Report and Written Opinion for Application No. PCT/NZ2009/000234 dated Sep. 24, 2010.
Han, C. C. et al., *A New Multimode Rectangular Horn Antenna Generating a Circularly Polarized Elliptical Beam*, Reprinted from IEEE Trans Antennas Propagat., vol. AP22, No. 6 (Nov. 1974), pp. 220-225.
Potter, P.D. et al., *Session 11: Antenna Feed Systems*, Reprinted from Northeast Electron. Res. and Eng. Meeting, (Nov. 1963), pp. 203-204.

* cited by examiner

*Primary Examiner* — Hoang V Nguyen
*Assistant Examiner* — Kyana R McCain
(74) *Attorney, Agent, or Firm* — Alston & Bird LLP

(57) ABSTRACT

An antenna assembly is provided that may include an antenna element having first and second opposed sides. The antenna element may be configured to transmit or receive signals of a desired wavelength. The antenna assembly may also include a first conductive surface disposed proximate the first side of the antenna element and lying in a plane substantially perpendicular to the antenna element, and a second conductive surface disposed proximate the second side of the antenna element and lying in a plane substantially perpendicular to the first antenna element. The second conductive surface may be substantially parallel to, and spaced apart from, the plane in which the first conductive surface lies. Collectively the first and second conductive surfaces may be configured to excite wave propagation modes of a higher order than a fundamental propagation mode for reception or transmission of signals of the desired wavelength by the antenna element.

18 Claims, 7 Drawing Sheets

ANTENNA ASSEMBLY

FIELD OF THE INVENTION

Exemplary embodiments of the present invention relate generally to antenna construction and, more particularly, relate to an antenna assembly for operating in higher-order wave propagation modes.

BACKGROUND OF THE INVENTION

Radar systems are used in a wide variety of applications. For example, some radar systems are used in aircraft and watercraft applications for tracking and/or measuring distances to objects. In mobile applications, such as, implementations of radar systems on aircraft and watercraft, limiting the size and weight of a radar system can be desirable. In some instances, the weight and size of the antenna assemblies used by a radar system may be limited by the application. As such, in many settings, it is often desirable to minimize the size and weight of the radar systems, and particularly the size and weight of the antenna assemblies of the radar system.

BRIEF SUMMARY OF THE INVENTION

Exemplary embodiments of the present invention provide a reduced profile antenna assembly as compared to conventional solutions. Exemplary embodiments include an antenna element, such as a microstrip antenna array. The antenna element may be configured or optimized to transmit and/or receive a signal of a desired frequency. The desired frequency may define a desired wavelength, which may be used as a design parameter for an exemplary antenna assembly.

According to some exemplary embodiments, the antenna element may be disposed in a U-shaped channel created by a two parallel surfaces that extend from the antenna element, and are perpendicular to the antenna element. According to various embodiments, the two parallel surfaces may be comprised of a conductive substance. The orientation of the two parallel surfaces may be configured to excite wave propagation modes of a higher order than a fundamental propagation mode for transmission or reception by the antenna element. In this regard, spacing between the two parallel surfaces may be configured to provide for higher order wave propagation modes.

One exemplary embodiment of the present invention may be an antenna assembly. The antenna assembly may comprise

BRIEF DESCRIPTION OF THE SEVERAL VIEWS OF THE DRAWING(S)

Having thus described exemplary embodiments of the present invention in general terms, reference will now be made to the accompanying drawings, which are not necessarily drawn to scale, and wherein:

DETAILED DESCRIPTION OF THE INVENTION

Figure 1:
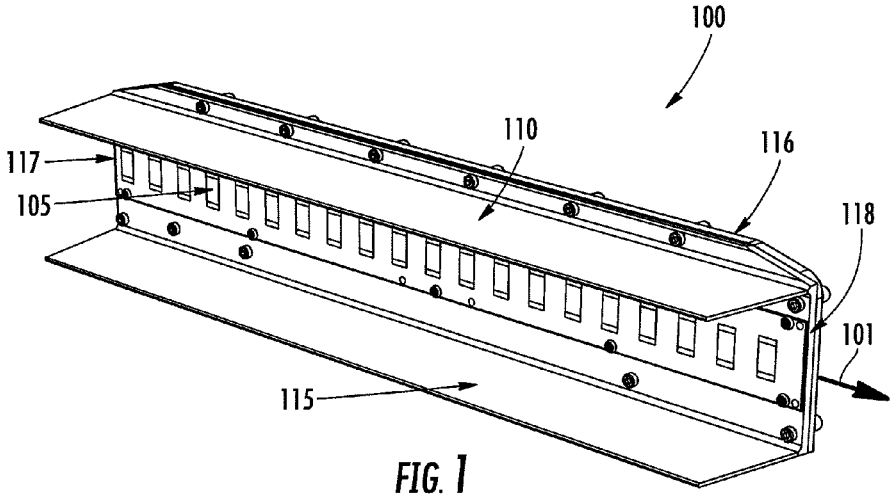
FIG. 1 is a perspective view of an antenna assembly according to various exemplary embodiments of the present invention.

Exemplary embodiments of the present invention will now be described more fully hereinafter with reference to the accompanying drawings, in which some, but not all embodiments of the present invention are shown. Indeed, the present invention may be embodied in many different forms and should not be construed as limited to the exemplary embodiments set forth herein; rather, these exemplary embodiments are provided so that this disclosure will satisfy applicable legal requirements. Like reference numerals refer to like elements throughout. As used herein, the terms "major" may refer to a longer edge of a structure, while the term "minor" may refer to a shorter edge of a structure. Terms such as "substantially," "about," "approximately" or the like as used in referring to a relationship between two objects is intended to reflect not only an exact relationship but also variances in that relationship that may be due to various factors such as the effects of environmental conditions, common error tolerances or the like. It should further be understood that although some values or other relationships may be expressed herein without a modifier, these values or other relationships may also be exact or may include a degree of variation due to various factors such as the effects of environmental conditions, common error tolerances or the like.

FIG. 1 depicts a perspective view of an antenna assembly 100 according to an exemplary embodiment of the present invention. The antenna assembly 100 may include an antenna element 105, a first conductive surface 110, a second conductive surface 115, and a support structure 116.

The antenna element 105 may any type of antenna for receiving and/or transmitting electromagnetic signals, such as a microstrip antenna, a slotted waveguide antenna, or the like. In some exemplary embodiments, the antenna element 105 may be configured or optimized for transmitting and/or receiving signals of a desired frequency, which may be defined based on the application of the antenna assembly 100. For example, in a marine radar application, the antenna element may be configured or optimized for transmitting or receiving a signal at a frequency of 9.4 gigahertz. The desired frequency may have a corresponding desired wavelength of a signal to be received or transmitted by the antenna element 105. For example, if the desired frequency of a signal propagating in free space is 9.4 gigahertz, the desired wavelength may be approximately 32 millimeters. In some embodiments, the antenna element 105 may be configured based upon the desired wavelength, such as in a full-wavelength, half-wavelength, or quarter-wavelength configuration.

The antenna element 105 may be an antenna array including a plurality of antenna nodes configured or optimized for a desired radiation pattern. In some exemplary embodiments, the antenna element may be a microstrip array including a plurality of microstrip antenna nodes.

In some exemplary embodiments, the antenna assembly 100 may include a waveguide (not depicted). The waveguide may be disposed along the axis 101. Further, the waveguide may be disposed in front of the antenna element 105 such that signals may be received through the waveguide. In some exemplary embodiments, the waveguide may be a slotted waveguide.

The antenna element 105 may be electrically connected to a processor (not depicted). The processor may be configured to generate a signal to be provided to the antenna element 105 for transmission, and/or receive a signal from the antenna element 105 and process the signal for use in various applications. In some exemplary embodiments, the processor may drive a radar system configured to track or locate objects. The processor may be a microprocessor, a coprocessor, a controller, an ASIC (application specific integrated circuit), an FPGA (field programmable gate array), a hardware accelerator, or the like.

The first and second conductive surfaces 110, 115 may be plate or fin-type structures. In this regard, the conductive surfaces 110, 115 may be planar. The conductive surfaces 110, 115 may also be rectangular in shape, and may have substantially-identical dimensions. In some exemplary embodiments, the conductive surfaces 110, 115 may include a bracket, angled portion, or other means for affixing the conductive surfaces 110, 115 to the support structure 116 of the antenna assembly 100. The first and second conductive surfaces 110, 115 may be disposed on either side of the antenna element 105. In some exemplary embodiments, the conductive surfaces 110, 115 may be disposed on either side of the antenna element 105 such that the antenna element is centrally located between the conductive surfaces 110, 115. Moreover, the conductive surfaces 110, 115 may be disposed on opposing sides of the antenna element. The conductive surfaces 110, 115 may lay in a plane substantially perpendicular to the antenna element 105 and the conductive surfaces 110, 115 may be substantially parallel to each other. The conductive surfaces 110, 115 may extend along an axis 101 and the conductive surfaces 110, 115 may be oriented parallel to the axis 101. The conductive surfaces may extend for the length of the antenna element 105. Further, the conductive surfaces 110, 115 may extend outwards from the antenna element 105. In this regard, the conductive surfaces may be substantially perpendicular to the antenna element 105.

The conductive surfaces 110, 115 may be formed of any type of conductive material including, for example, metals such as aluminum or an aluminum alloy. Alternatively, for example, the conductive surfaces 110, 115 may be formed of non-conductive materials having an applied conductive material (e.g., conductive paint or conductive paste).

The support structure 116 may provide support to the antenna element 105 and the conductive surfaces 110, 115. In some exemplary embodiments, the support structure may be conductive or comprised of a conductive material. The antenna element 105 and the conductive surfaces 110, 115 may be affixed to the support structure 116 to maintain the relative configuration of the antenna element 105 and the conductive surfaces 110, 115. According to various exemplary embodiments, the support structure 116 may be devoid of any surfaces that extend outward from the antenna element 105 along the ends 117, 118 of the antenna element 105 (i.e., surfaces in planes perpendicular to both the antenna element 105 and conductive surfaces 110, 115). Further, in some exemplary embodiments, the composition and/or configuration of the support structure 116 may prevent signals from being received or transmitted by the antenna element 105 in the direction opposite the side that the antenna element 105 is affixed to the support structure 116 (i.e., the back side of the support structure 116).

Figure 2:
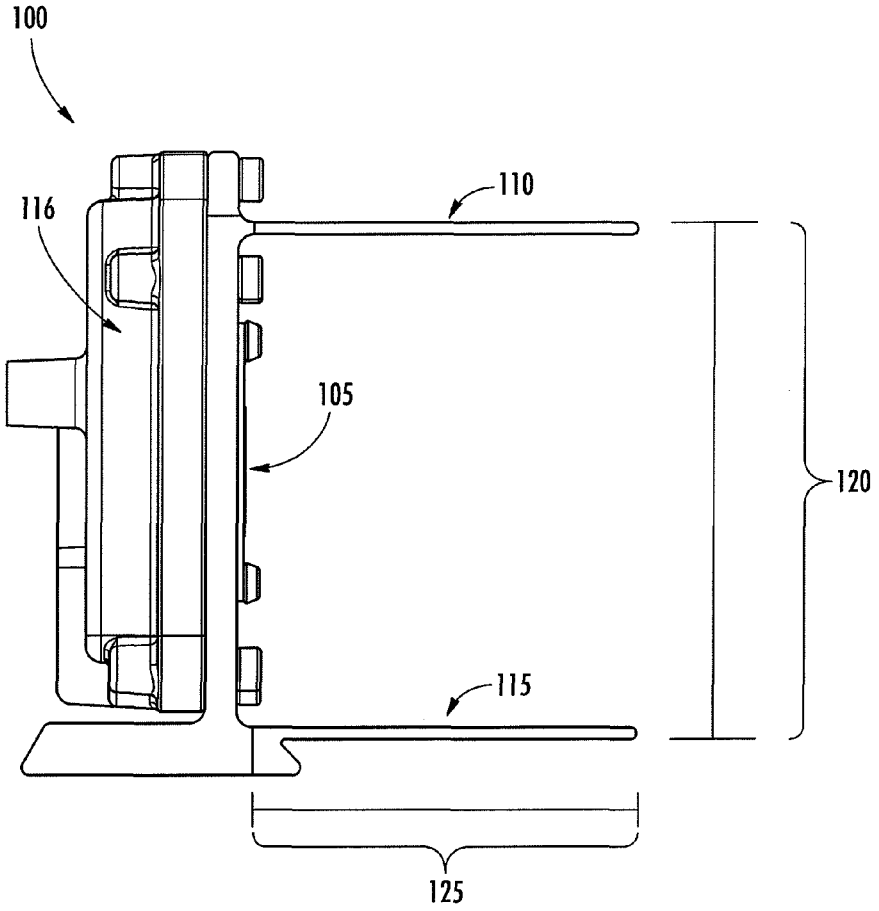
FIG. 2 is a side view of an antenna assembly according to various exemplary embodiments of the present invention.
Figure 3:
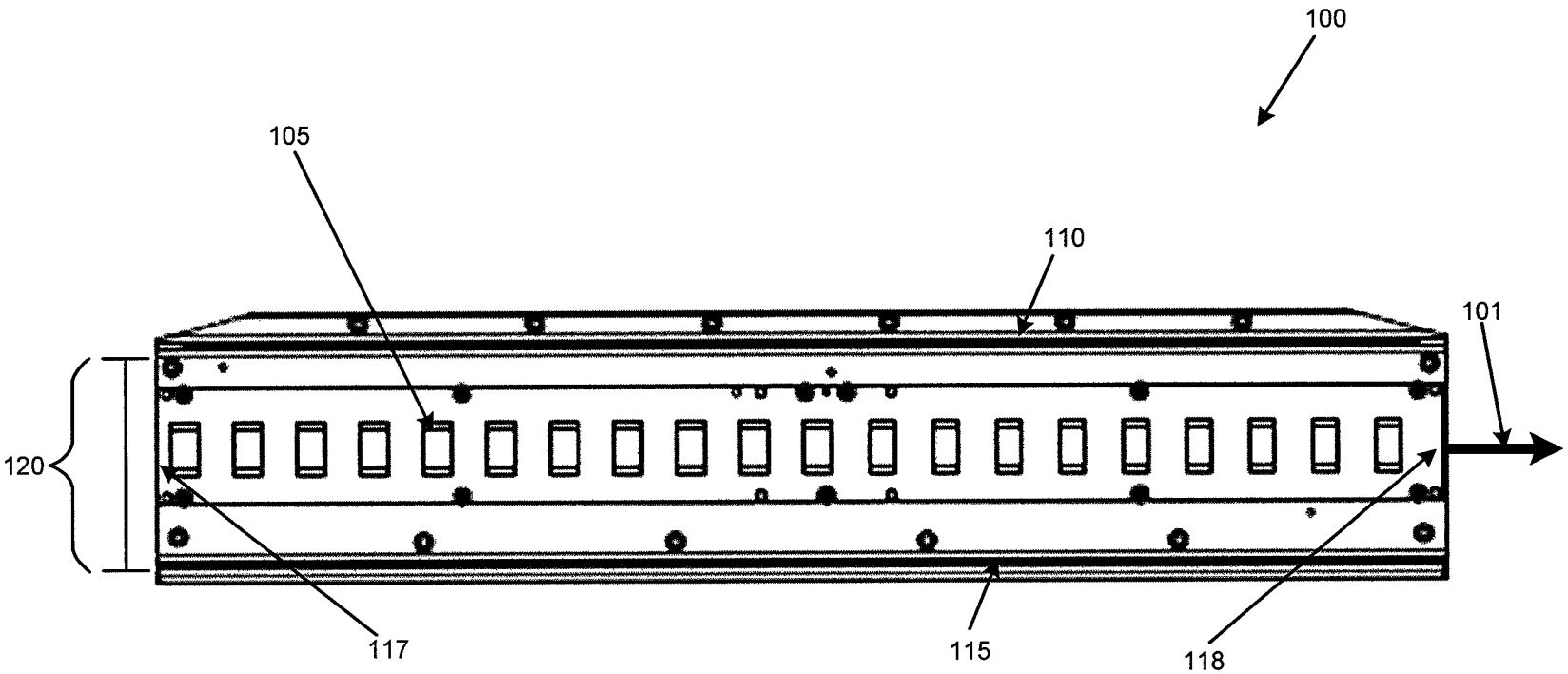
FIG. 3 is a front view of an antenna assembly according to various exemplary embodiments of the present invention.

Referring now to FIGS. 2 and 3, side and front views of the antenna assembly 100 are depicted. As describe above and depicted more clearly in FIGS. 2 and 3, the conductive surfaces 110, 115 extend outwards from the antenna element 105, and are substantially perpendicular to the antenna element 105. Further, FIGS. 2 and 3 depict more clearly that the conductive surfaces 110, 115 may be parallel to each other. Also, as a result of the conductive surfaces 110, 115 being spaced apart and disposed on either side of the antenna element 205, the conductive surfaces 110, 115 may define a separation distance 120 between the conductive surfaces 110, 115.

The separation distance 120 may be configured based on the wavelength of a signal having the desired frequency and corresponding desired wavelength for the antenna element 105. In some exemplary embodiments, the separation distance 120 may be less than three times the desired wavelength for the antenna element 105. More particularly, for example, the separation distance 120 may be at least about 1.85 times the desired wavelength, and/or may be no more than about 2.1 times the desired wavelength. For example, if the desired wavelength is 32 millimeters (corresponding to a frequency of 9.4 gigahertz), the separation distance 120 may be less than 96 millimeters, and may be more particularly about 62 millimeters.

The side view of FIG. 2 also more clearly depicts a width 125 of the conductive surfaces 110, 115. In some exemplary embodiments, the width 125 of the conductive surfaces 110, 115 may be from about 0.7 times the desired wavelength to about two times the desired wavelength. For example, if the desired wavelength is 32 millimeters (corresponding to a frequency of 9.4 gigahertz), the width 125 may be about 50 millimeters. In some instances, the width 125 may be determined based on manufacturing limitations or size limitations for a particular application of the antenna assembly 100. Further, in some exemplary embodiments, the width 125 may be greater than two times the desired wavelength.

As described above, parameters of the conductive surfaces 110, 115 (e.g., separation distance 120 and the width 125) may be selected to configure the operation of the antenna assembly 100. In this regard, the parameters of the may be selected to enable excitation of wave propagation modes of a higher order than a fundamental propagation mode for a wave. By selecting the parameters to generate an antenna assembly for exciting higher-order modes of a signal, a lower-profile antenna assembly may be constructed over conventional solutions.

Figure 4:
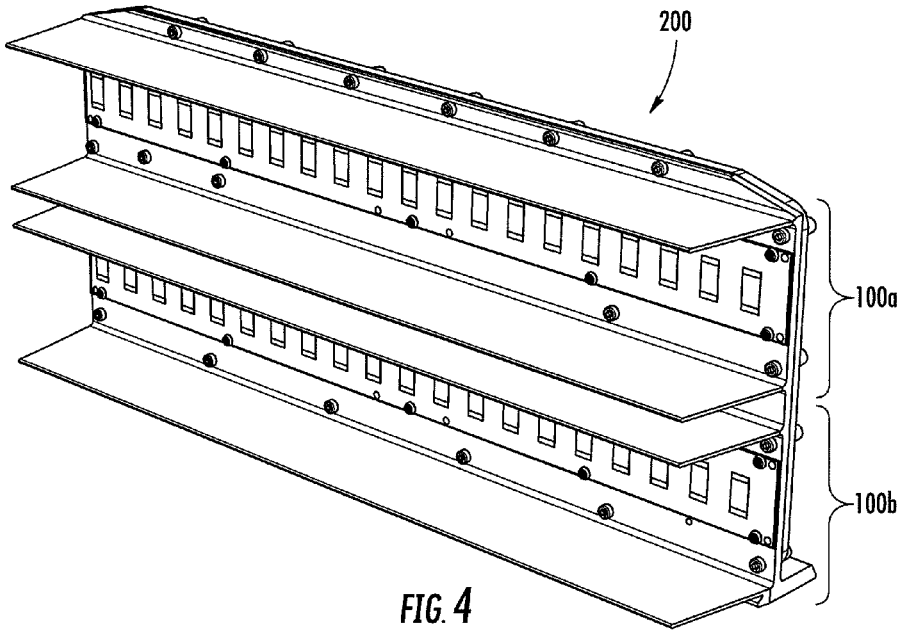
FIG. 4 is a perspective view of an antenna assembly including a receive module and a transmit module according to various exemplary embodiments of the present invention.
Figure 5:
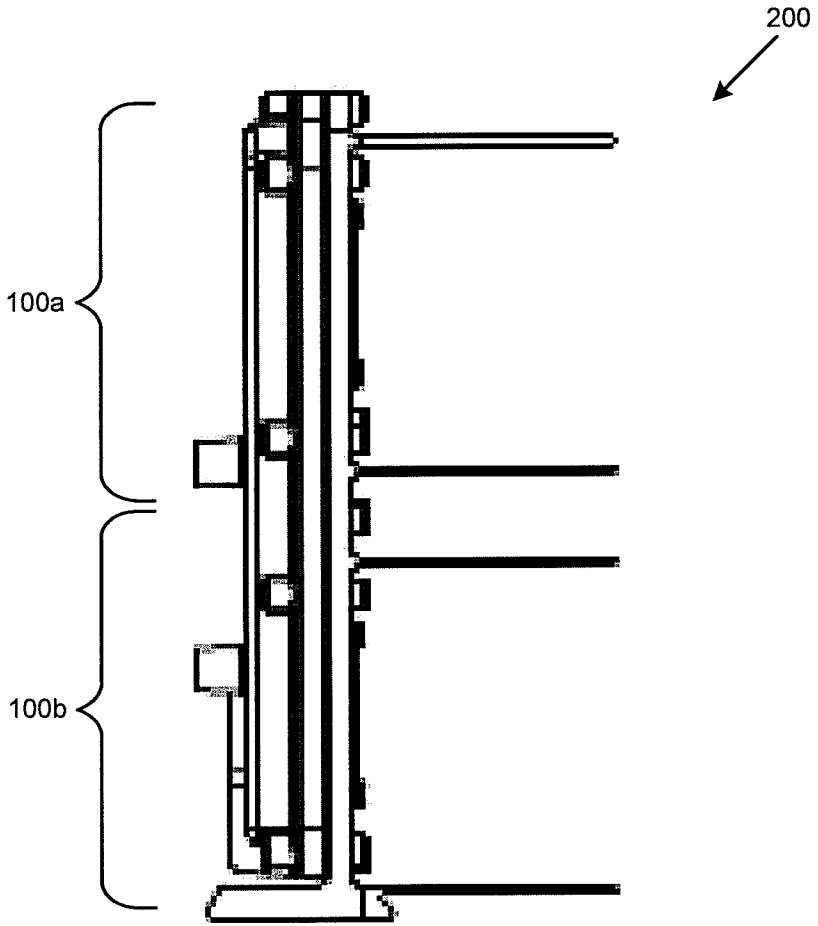
FIG. 5 is a side view of an antenna assembly including a receive module and a transmit module according to various exemplary embodiments of the present invention.
Figure 6:
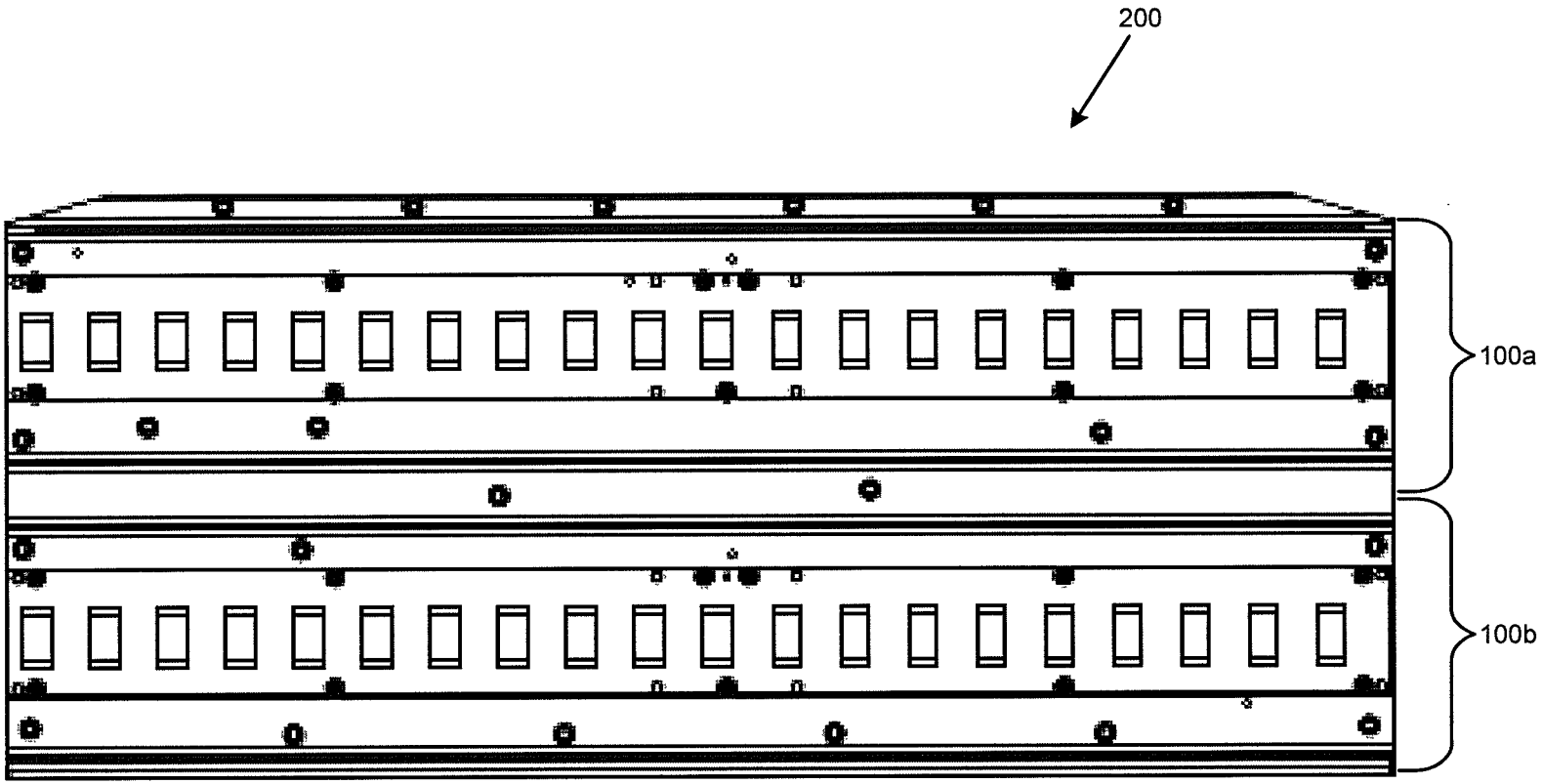
FIG. 6 is a front view of an antenna assembly including a receive module and a transmit module according to various exemplary embodiments of the present invention.

FIG. 4 depicts an antenna arrangement 200 according to another exemplary embodiment of the present invention. The antenna arrangement 200 includes two antenna assemblies 100*a*, 100*b*, each of which may be configured in the same manner described with respect to the antenna assembly 100 shown in FIGS. 1-3. According to various exemplary embodiments, one of the antenna assemblies 100*a*, 100*b* may be a receiver antenna assembly and the other may be a transmitter antenna assembly. In some exemplary embodiments, the antenna assembly 100*a* may be disposed above the antenna assembly 100*b*. As a result of this configuration, one of the antenna assemblies 100*a*, 100*b* may transmit a signal that is reflected by an object and received by the other antenna assembly. FIG. 5 depicts a side view of the antenna arrangement 200 and FIG. 6 depicts a front view of the antenna arrangement 200.

Figure 7:
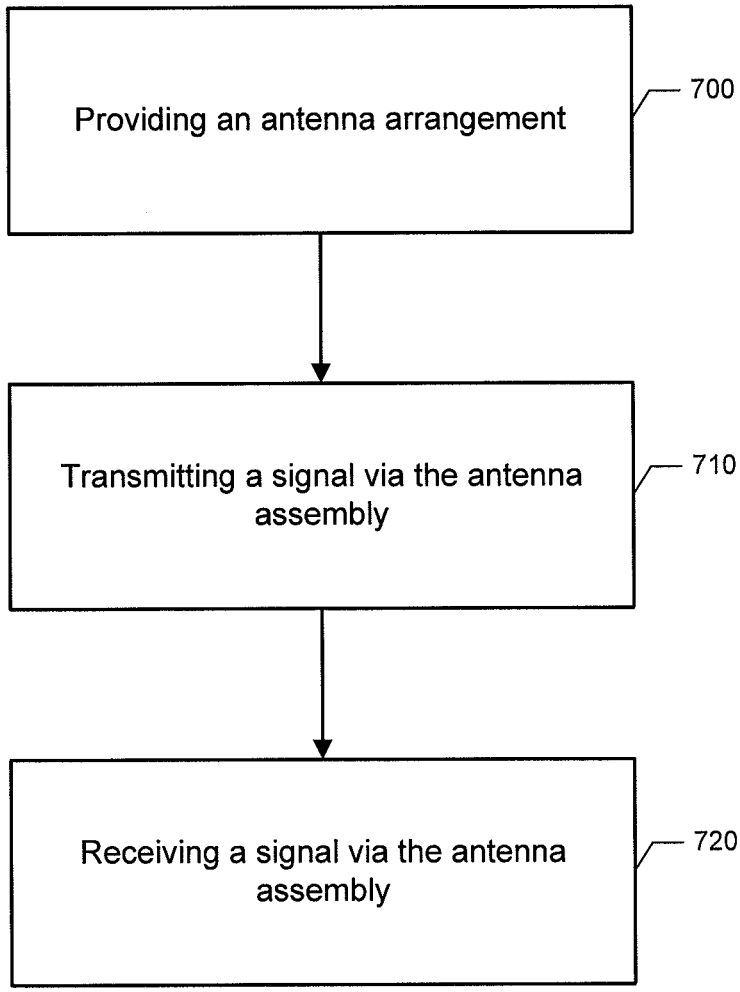
FIG. 7 is a flowchart of a method according to various exemplary embodiments of the present invention.

FIG. 7 is a flowchart of a method according to various embodiments of the present invention. The exemplary method may include providing an antenna assembly at 700. The provided antenna assembly may be comprised as described above. The exemplary method of FIG. 7 may also include transmitting a signal via the antenna arrangement at 710. The exemplary method may also include receiving a signal via the antenna arrangement at 720.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions other than those explicitly described above are also contemplated as may be set forth in some of the appended claims. Although specific terms are employed herein, they are used in a generic and descriptive sense only and not for purposes of limitation.

That which is claimed:

1. An apparatus comprising:

an antenna element having first and second opposed sides, the antenna element being configured to transmit or receive signals of a desired wavelength;

a first conductive surface disposed proximate the first side of the antenna element and lying in a plane substantially perpendicular to the antenna element;

a second conductive surface disposed proximate the second side of the antenna element and lying in a plane substantially perpendicular to the first antenna element and substantially parallel to, and spaced apart from, the plane in which the first conductive surface lies;

wherein the first and second conductive surfaces extend outwardly from the antenna element to a height of at least approximately 0.7 times the desired wavelength, and wherein collectively the first and second conductive surfaces are configured to excite wave propagation modes of a higher order than a fundamental propagation mode for reception or transmission of signals of the desired wavelength by the antenna element.

2. The apparatus of claim 1, wherein the antenna element comprises a microstrip array.

3. The apparatus of claim 1, wherein the first conductive surface and the second conductive surface are rectangular-shaped.

4. The apparatus of claim 1, wherein the first conductive surface and the second conductive surface have substantially the same dimensions.

5. The apparatus of claim 1, wherein the first and second conductive surfaces are spaced apart by less than three times the desired wavelength.

6. The apparatus of claim 1, wherein the first and second conductive surfaces are spaced apart by at least about 1.85 times the desired wavelength, and by no more than about 2.1 times the desired wavelength.

7. The apparatus of claim 1, wherein the desired wavelength is about 32 millimeters, and wherein the first and second conductive surfaces are spaced apart by about 62 millimeters.

8. The apparatus of claim 1, wherein the antenna element and first and second conductive surfaces form a first antenna assembly, and wherein the apparatus further comprises:

a second antenna assembly comprising an antenna element and first and second conductive surfaces separate from the antenna element and first and second conductive surfaces of the first antenna assembly, wherein the first antenna assembly is configured to transmit signals of the desired wavelength, and the second antenna assembly is configured to receive signals of the desired wavelength.

9. The antenna assembly of claim 1 further comprising a support structure to which the antenna element and first and second conductive surfaces are affixed, the support structure being devoid of any conductive surface disposed proximate the antenna element and lying in a plane perpendicular to the antenna element and the planes of the first and second conductive surfaces.

10. A method comprising:

providing an antenna assembly comprising:

an antenna element having first and second opposed sides, the antenna element being configured to transmit or receive signals of a desired wavelength;

a first conductive surface disposed proximate the first side of the antenna element and lying in a plane substantially perpendicular to the first antenna element;

a second conductive surface disposed proximate the second side of the antenna element and lying in a plane substantially perpendicular to the first antenna element and substantially parallel to, and spaced apart from, the plane in which the first conductive surface lies;

wherein the first and second conductive surfaces extend outwardly from the antenna element to a height of at least approximately 0.7 times the desired wavelength, and wherein collectively the first and second conductive surfaces are configured to excite wave propagation modes of a higher order than a fundamental propagation mode for reception or transmission of signals of the desired wavelength by the antenna element; and transmitting a signal via the antenna arrangement.

11. The method of claim 10, wherein providing the antenna assembly includes the antenna element comprising a microstrip array.

12. The method of claim 10, wherein providing the antenna assembly includes the first conductive surface and the second conductive surface being rectangular-shaped.

13. The method of claim 10, wherein providing the antenna assembly includes the first conductive surface and the second conductive surface having substantially the same dimensions.

14. The method of claim 10, wherein providing the antenna assembly includes the first and second conductive surfaces being spaced apart by less than three times the desired wavelength.

15. The method of claim 10, wherein providing the antenna assembly includes the first and second conductive surfaces being spaced apart by at least about 1.85 times the desired wavelength, and by no more than about 2.1 times the desired wavelength.

16. The method of claim 10, wherein providing the antenna assembly includes the desired wavelength being about 32 millimeters, and the first and second conductive surfaces being spaced apart by about 62 millimeters.

17. The method of claim 10, wherein providing the antenna assembly includes the antenna element and first and second conductive surfaces forming a first antenna module, and the antenna assembly further comprising a second antenna module comprising an antenna element and first and second conductive surfaces separate from the antenna element and first and second conductive surfaces of the first antenna module, the first antenna module being configured to transmit signals of the desired wavelength, and the second antenna module being configured to receive signals of the desired wavelength.

18. The method of claim 10, wherein providing the antenna assembly includes the antenna assembly further comprising a support structure to which the antenna element and first and second conductive surfaces are affixed, the support structure being devoid of any conductive surface disposed proximate the antenna element and lying in a plane perpendicular to the antenna element and the planes of the first and second conductive surfaces.

* * * * *